United States Patent [19]

Holmberg

[11] Patent Number: 5,075,591

[45] Date of Patent: Dec. 24, 1991

[54] MATRIX ADDRESSING ARRANGEMENT FOR A FLAT PANEL DISPLAY WITH FIELD EMISSION CATHODES

[75] Inventor: Scott H. Holmberg, Pleasanton, Calif.

[73] Assignee: Coloray Display Corporation, Fremont, Calif.

[21] Appl. No.: 553,428

[22] Filed: Jul. 13, 1990

[51] Int. Cl.[5] ..... H01J 1/30; H01J 19/24

[52] U.S. Cl. ..... 313/495; 313/268; 313/309; 313/336; 313/351; 313/355

[58] Field of Search ..... 313/495, 309, 355, 351, 313/868, 336

[56] References Cited

U.S. PATENT DOCUMENTS

| | | | |
|---|---|---|---|
| 3,753,022 | 8/1973 | Fraser, Jr. | 313/355 X |
| 4,721,885 | 1/1988 | Brodie | 313/351 X |
| 4,940,916 | 7/1990 | Borel et al. | 313/351 X |
| 4,987,377 | 1/1991 | Gray et al. | 313/309 X |

*Primary Examiner*—Palmer C. DeMeo

*Attorney, Agent, or Firm*—Flehr, Hohbach, Test, Albritton & Herbert

[57] ABSTRACT

A matrix addressed flat panel display, is disclosed herein and includes a lower planar array of spaced apart, parallel, electrically conductive leads and a matrix array of field emission cathodes connected to and extending up from the lower planar array of electrically conductive leads. An upper matrix array of spaced-apart parallel electrically conductive leads is located above and spaced from the lower array of leads and from the cathodes, such that the upper leads extend normal to the lower leads, crossing the latter immediately above the cathodes, and such that those segments of the upper leads that actually cross over the lower leads are positioned in a plane closer to the lower leads than the rest of the upper leads. The upper and lower planar arrays of leads are electrically insulated from one another by means of a pair of separately formed layers of dielectric material disposed therebetween.

17 Claims, 2 Drawing Sheets

MATRIX ADDRESSING ARRANGEMENT FOR A FLAT PANEL DISPLAY WITH FIELD EMISSION CATHODES

BACKGROUND OF THE INVENTION

The present invention relates generally to matrix addressing arrangements and, more particularly, to improvements in a matrix addressing arrangement especially suitable for use as part of matrix addressed flat panel display or other such device requiring matrix addressing.

A representative matrix-addressed flat panel display in the prior art is described in U.S. Pat. No. 4,857,799, which is incorporated herein by reference. The display described there includes a transparent face plate mounted over and spaced from a backing plate so as to define an interior chamber. The transparent face plate carries on its internal surface a thin coating or film of electrically conductive transparent material, such as indium tin oxide, which serves as an accelerator plate and a phosphor-coating. The internal surface of the backing plate supports a matrix array of field emission cathodes in confronting relationship with the face plate and suitable address means for energizing selected ones of the field emission cathodes, thereby causing the energized cathodes to bombard the phosphor-coated face plate which, in turn, results in the emission of visible light. It is this light that is viewed by the observer through the face plate, that is, on the screen of the flat panel display.

Still referring to U.S. Pat. No. 4,857,799, the address means forming part of the display illustrated there includes: a lower planar array of spaced apart, parallel, electrically conductive row leads which are formed on the top surface of the displays backing plate and which support the matrix array of field emission cathodes; an upper planar array of spaced-apart, parallel, electrically conductive column leads located above and spaced from the lower array of leads and field emission cathodes such that the upper leads extend normal to the lower leads, crossing the latter immediately above the cathodes; and a layer of dielectric material disposed between the upper and lower arrays of electrically conductive leads. This combination of components is diagrammatically illustrated in FIG. 1.

As seen in FIG. 1, the backing plate, which is generally indicated at 10, supports the lower electrically conductive row leads, one of which is designated by the reference numeral 12. Each lower row lead 12 supports one or more field emission cathodes 14. Spaced above the row leads 12 are the column leads, one of which is shown at 16. Between these leads is a layer 18 of suitable dielectric material. Note specifically that in a typical matrix addressing arrangement, the column leads extend normal to the row leads and, at each juncture where these leads cross, one or more of the field emission cathodes are positioned within cooperating apertures, one of which is indicated at 20 in FIG. 1. Each of these apertures 20 extends through the upper column leads 16 and also through dielectric layer 18.

While the matrix-addressed flat panel display disclosed in U.S. Pat. No. 4,857,799 is generally satisfactory for its intended purpose, there are certain aspects of the display which can be improved upon. For example, if the dielectric layer 18 illustrated in FIG. 1 is too thin, defects in this layer could result in electrically shorting together a row lead with a crossing column lead, as diagrammatically illustrated in FIG. 1, at 22. Moreover, the closer the column electrodes are to the row electrodes, the greater the capacitance is between the two, thereby increasing the RC time constant associated with the addressing operation of the display. If this RC time constant is too large, the addressing operation may be too slow for the intended purpose of the display. One way to overcome these disadvantages is to increase the thickness of dielectric layer 18. However, in the typical process of making flat panel displays utilizing a single deposition step to form its field emission cathodes, this would place the column leads, which serve as gates, too far from the tips of the field emission cathodes. A solution to this problem is to form the cathodes by means of a double deposition process, as described in co-pending U.S. patent application Ser. No. 472,336, filed Jan. 29, 1990 and incorporated herein by reference.

SUMMARY OF THE INVENTION

It is a primary object of the present invention to overcome all of the above-discussed disadvantages associated with the arrangement in FIG. 1 without having to resort to a double-deposition process.

As will be described in more detail hereinafter, a matrix addressed flat panel display designed in accordance with the present invention is disclosed herein. This display utilizes a matrix array of field emission cathodes that are selectively addressed by a matrix addressing arrangement. The matrix addressing arrangement includes a dielectric base or substrate supporting a first or lower planar array of spaced apart, parallel electrically conductive leads electrically connected with and supporting the cathodes, and a second or upper planar array of spaced apart, parallel, electrically conductive leads located above and spaced from the lower array such that the upper array of leads extend normal to the lower array of leads.

In accordance with one feature of the present invention, at least one pair of separately formed adjacent upper and lower layers of dielectric material is disposed between the upper and lower arrays of electrically conductive leads for electrically insulating the two arrays from one another. These adjacent layers of dielectric material and the upper array of leads together define a matrix array of apertures, each of which contains one field emission cathode. Because the two dielectric layers are separately formed even if there are microscopic defects in both of these layers, it is highly unlikely that the defects will line up with another and thereby result in a short between the upper and lower electrically conductive leads. In one preferred embodiment, the two separately formed dielectric layers are formed of different material, each of which is selected so that it can be chemically etched by a particular chemical that will not chemically etch the other material. In a second preferred embodiment, the lower of the two dielectric layers is a film of anodized metal. In that case, the lower leads are constructed of anodizable metal, for example, aluminum, and each lead is anodized, that is on its top surface, to provide the desired film.

A second feature of the present invention, as will be seen hereinafter, resides in the particular configuration of the apertures and the upper electrically conductive leads forming part of the overall flat panel display. More specifically, those segments of the upper electrically conductive leads that actually cross over the lower leads are positioned in a plane closer to the lower leads than the rest of the upper leads. In that way, as will be seen, for most of the upper and lower leads, a relatively large spacing is maintained so as to display relatively lower capacitance between the leads. At the same time those segments of the upper leads directly over the uppermost tips of the cathodes are positioned closer to the cathodes, without requiring a double deposition process as described above.

BRIEF DESCRIPTION OF THE DRAWINGS

The overall matrix addressing arrangement and its associated flat panel display will be described in more detail hereinafter in conjunction with the drawings, wherein.

DESCRIPTION OF THE PREFERRED EMBODIMENTS

Figure 1:
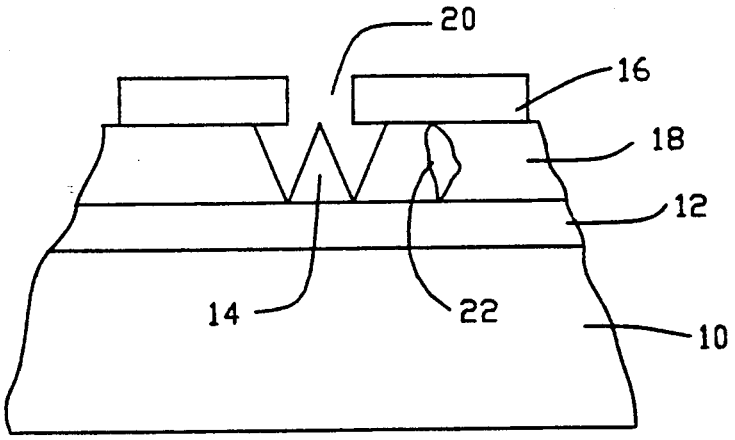
(PRIOR ART) FIG.—1
FIG. 1 a diagrammatic illustration, in side elevational view, of part of a flat panel display typically found in the prior art.
Figure 3:
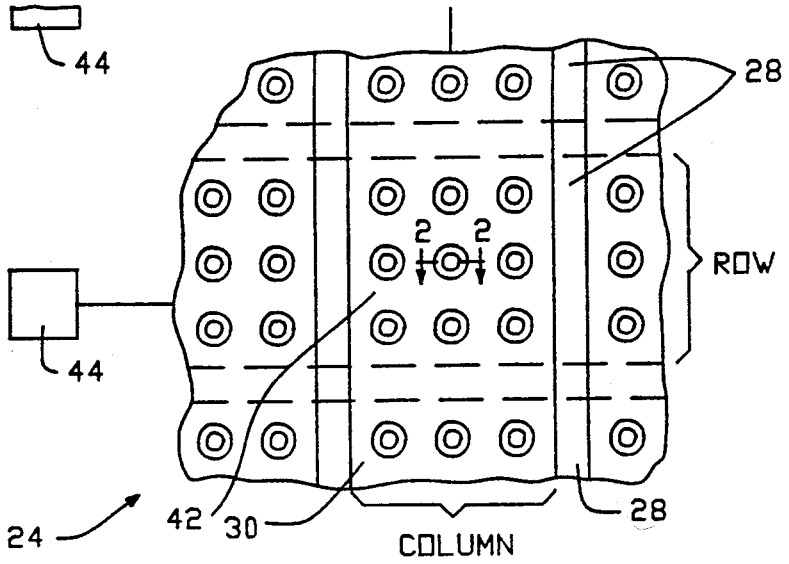
FIG. 3 is a diagrammatic illustration, in plan view, of part of the display shown in FIG. 2.
Figure 2:
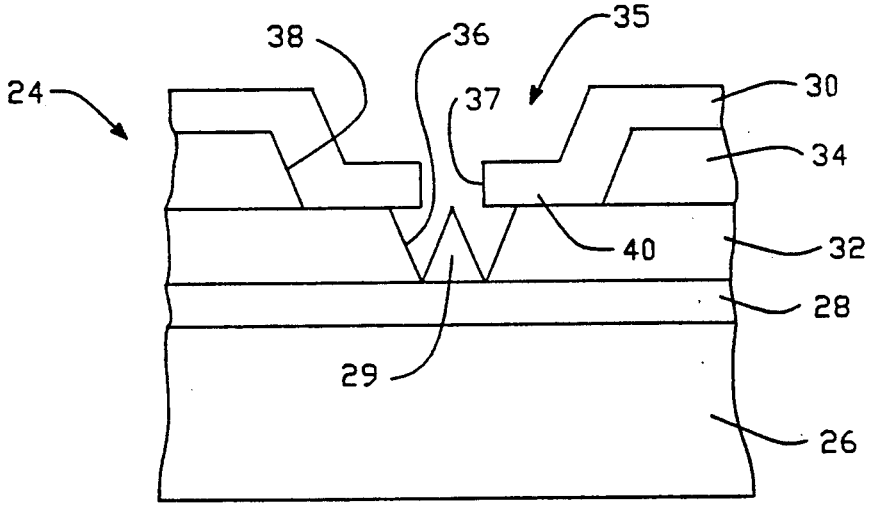
FIG. 2 is a diagrammatic illustration, in side elevational view, of part of an overall flat panel display designed in accordance with the present invention.

Turning now to the drawings, wherein like components are designed by like reference numerals through the various figures, attention is immediately directed to FIGS. 2 and 3 since FIG. 1 has been discussed previously. FIGS. 2 and 3 illustrate part of an overall matrix addressed flat panel display designed in accordance with the present invention and generally designated by the reference numeral 24. Flat panel display 24 includes a dielectric base 26 supporting a lower planer array of spaced apart, parallel, electrically conductive row leads 28 which, in turn, support a matrix array of field emission cathodes 29, in the same manner as the arrangement illustrated in FIG. 1. Like this latter arrangement, display 24 also includes an upper planar array of spaced apart, parallel, electrically conductive column leads 30 spaced above the lower leads 28 such that upper leads extend normal to the lower leads, crossing the latter immediately above cathodes 29. This is best illustrated in FIG. 3 which depicts three row leads 28 and three column leads 30. Note specifically that the group of cathodes 29 are located at each of the crossing junctures defined by the row and column leads.

Referring specifically to FIG. 2, in accordance with one embodiment of the present invention, column leads 30 are electrically insulated from row leads 28 by means of two separately formed layers 32 and 34 of dielectric material. These two layers and the upper column leads together define a matrix array of apertures 35 which serve to contain field emission cathodes 29 and segments of column leads 30. Specifically, as shown in FIG. 2, each of the apertures 35 includes a lower aperture section 36 extending through the lower dielectric layer for accommodating an associated cathode 29 which extends upward to the top of the lower dielectric layer. Each aperture also includes an upper aperture section 38 which is larger in diameter than its associated lower aperture section In that way, a segment 40 of each upper lead 30 can be positioned circumferentially around aperture section 36 closer to its associated field emission cathode than the rest of the column lead. In fact, as illustrated in FIG. 2, each segment 40 is positioned in the same plane as the uppermost tip of its associated cathode and, thereby, has the advantage of being as close as possible to the tip. On the other hand, in most of the area between each crossing row lead and column lead, each column lead nevertheless is spaced further from its associated row lead by an amount equal to the thickness of upper layer 34. This is best illustrated in FIG. 3. Note specifically the square crossing area 42 which for illustrative purposes, contains nine field emission cathodes 29 and associated apertures 35.

A primary advantage to flat panel display 24, as compared to the arrangement illustrated in FIG. 1, resides in the utilization of two separately formed dielectric layers, rather than a single layer. In the former case, should both the upper and lower dielectric layers 32 and 34 contain a defect, it is highly unlikely that both defects would be vertically aligned with one another. As a result, it is very unlikely that a short between the row and, electrodes, would result. While it is true that there is only a single layer of dielectric material, specifically, lower layer 32, between each of the column segments 40 of rows 28, the total area under these segments is quite small as compared to the area containing two dielectric layers between crossing column and row leads. Therefore, the likelihood of a defect present in the lower dielectric layer, between a segment 40 of column lead 30 and the underlying section of row lead 28 is quite small.

Another advantage associated with the configuration of FIG. 2 is that the double layer of insulation between crossing leads decreases the capacitance therebetween (as compared to a single layer) and therefore decreases the RC time constant of the overall matrix addressing circuit. However, at the same time, segments 40 of leads 30 are positioned in plane with the tips of cathodes 29 and this does not require forming the cathodes by means of a double deposition process, as described in the previously recited co-pending application. This is because each of the cathodes is formed to have its height equal to the diameter of its base which corresponds to the dimensions of its associated aperture section 36, although the latter is undercut at its top end, as illustrated in FIG. 2.

Overall flat panel display 24 operates in the same manner as the display disclosed in U.S. Pat. No. 4,857,799 and other typical prior art displays. That is, selected ones of the cathodes 29 are energized so as to cause electrons to be emitted towards associated pixels on the display screen (not shown). Each cathode is energized by applying the appropriate field between its tip and adjacent column segment 40 which serves as a gate electrode. This requires selectively addressing the row and column leads in the usual manner, utilizing suitable drive means generally indicated at 44 in FIG. 3. These drive means and their associated rows and columns 28 and 30 form an overall addressing arrangement which comprises part of display 10.

The particular base plate arrangement illustrated in FIG. 2 can be formed utilizing conventional processing techniques. Briefly stated, the electrically conductive row leads 28 are first formed on the top surface of dielectric base 26 which can be self-supporting as shown or it can be supported on its own electrically conductive or semiconductive substrate, now shown. Next, dielectric layer 32, for example, silicon nitride, is formed over and between leads 28 so as to display a thickness equal to the contemplated diameter/height of cathodes 29. The top surface of this layer may be brush scrubbed to remove particular material therefrom. Dielectric layer 34, for example a layer of silicon dioxide, is formed over silicon nitride layer 32 and its top surface may also be brush scrubbed to remove particulate material.

Figure 4:
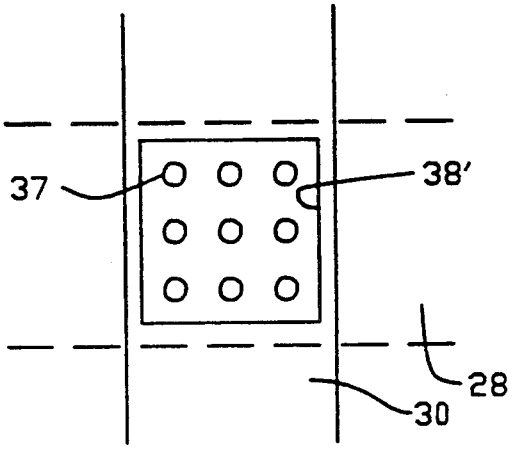
FIG. 4 diagrammatic illustration, in plan view, of a modified version of the display depicted in FIG. 3.

Still referring to a possible process to form the arrangement illustrated in FIG. 2, note specifically that the two dielectric layers 32 and 34 are made of different dielectric material. Specifically, these layers are selected such that each can be chemically etched by a particular chemical that will not chemically etch the other. In the particular examples set forth, silicon dioxide can be etched using buffered oxide etch (diluted HF or AmmoniumFlouride) which will not effect silicon nitride and the silicon nitride can be etched by $NF_3$ gas which will not effect the silicon dioxide. With this in mind, the next process step is to etch sections 38 of apertures 35 in silicon dioxide layer 34 using buffered oxide etch. Thereafter, the column leads 30 are formed on the top surface of dielectric layer 34 and the top surfaces of dielectric layer 32 that are exposed through aperture sections 38. In actual practice, a continuous semiconductive or conductive film from which the column leads are formed is initially provided. After forming column leads 30 or the continuous film, through holes 37 (forming part of the apertures 35) are etched through these leads or the continuous film concentrically within aperture section 38. Thereafter, $NF_3$ gas is used to etch aperture sections 36 in dielectric layer 32. Note that these latter aperture sections are etched back behind segments 40. Finally, utilizing a single deposition process, the individual cathodes 29 are formed within their respective aperture sections 36. At this time, if column leads 30 have not already been formed, they are so formed using a conventional photolithographic process. The individual steps making up the formation process just described are well known in the art and, hence, they were not described in detail. It is to be understood that there are various ways to ultimately form the backing plate arrangement illustrated in FIG. 2. Moreover, the overall arrangement itself may be modified from a structural standpoint. For example, before column leads 30 are formed, for any given crossing juncture 42 between adjacent row and column leads, a single upper aperture section 38' can be formed, rather than individual aperture sections 37, as illustrated in FIG. 4.

Figure 5:
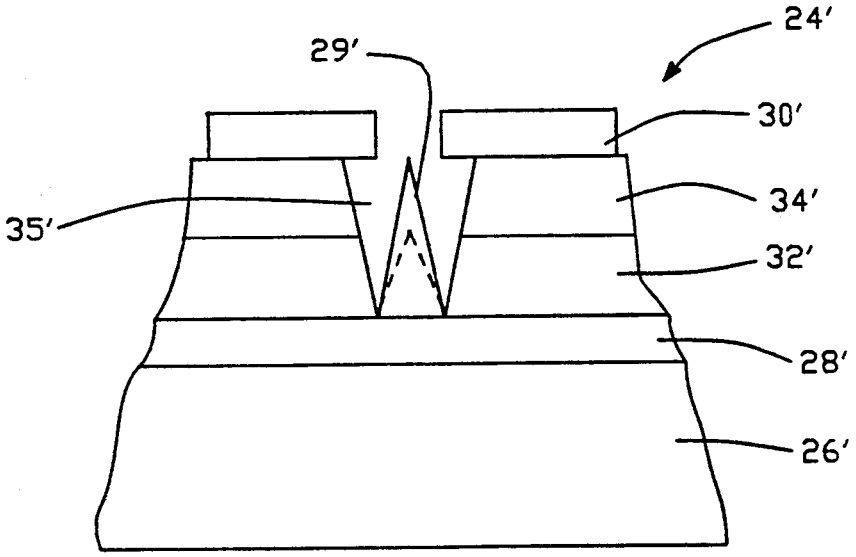
FIG. 5 is a diagrammatic illustration in side elevation, of a portion of a flat panel display designed in accordance with a further embodiment of the present invention.

Turning now to FIG. 5, part of the backing plate arrangement of a matrix addressed flat panel display 24' designed in accordance with a further embodiment of the present invention is illustrated. From a functional standpoint, display 24' may be identical to display 24. Like display 24, display 24' includes a corresponding dielectric backing plate 26, corresponding row and column leads 28' and 30', respectively, two separately formed dielectric layers 32' and 34', and corresponding cathodes 29'. However, in the case of arrangement 24', its overall apertures 35' are not formed of different diameter sections, except for the normal undercut, and column leads 30 do not include recessed segments 40. As a result, in order to place the tip of each cathode in the same plane as its adjacent column lead 30', the cathode must either be formed by means of a double deposition process or the total thickness of the two dielectric layers 32 and 34 must be approximately equal to the diameter of the cathodes base. However, the utilization of a double deposition process is more complicated and more expensive than a single deposition process would be. On the other hand, if the total thickness of the two dielectric layers is no greater than the base diameter of the cathodes, the capacitance between the row and column leads is greater than it would be if thicker dielectric layers were provided. In either case, the utilization of two separately formed dielectric layers minimizes the presence of shorts between the leads 28' and 30', even though the material making up the two dielectric layers may be the same.

Figure 6:
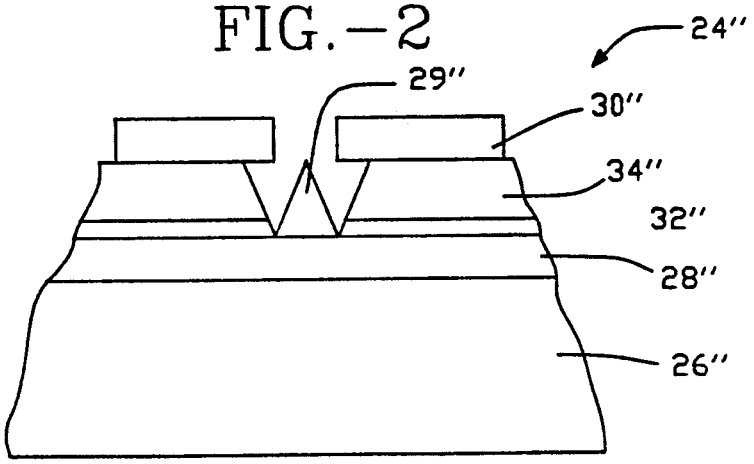
FIG. 6 is a diagrammatic illustration, in side elevation, of part of a flat panel display designed in accordance with still a further embodiment of the present invention.

Attention is now directed to FIG. 6 which illustrates part of the backing plate arrangement of a matrix addressed flat panel display designed in accordance with still another embodiment of the present invention. This embodiment is generally indicated by the reference numeral 24'' and functions in the same manner as displays 24 and 24'. Display 24'', like the other displays, includes dielectric base 26'', row and column leads 28'' and 30'', respectively, dielectric layers 32'' and 34'', and field emission cathodes 29''. In the case of display 24'', the total thickness of the two dielectric layers 32'' and 34'' is approximately equal to the base diameter of cathodes 29''. Therefore, these cathodes can be formed by means of a single deposition process. Upper dielectric layer 34'' which is the thicker of the two dielectric layers, as illustrated from FIG. 6, may be, for example, silicon dioxide or silicon nitride. In accordance with the present invention, layer 32'' is a film of anodized metal that appears on the entire top surface of each of the lower row leads 28''. This is accomplished by forming the leads 28'' from an anodizable metal, for example aluminum and thereafter anodizing the leads after they are formed to provide dielectric layers 32''. Another anodizable metal contemplated for use as leads 28'' is tantalum. In either case, the way in which the anodized film is formed is well known in the art.

While the various embodiments discussed above have been described in conjunction with the flat panel display, it is to be understood that the various aspects of the present invention can be embodied in devices other than displays. For example, a matrix addressed printer utilizing field emission cathodes might be designed with the present invention in mind.

What is claimed:

1. In a matrix addressing arrangement forming part of a matrix addressed flat panel display utilizing a matrix array of field emission cathodes that are selectively addressed by said arrangement, the latter including dielectric means supporting a first lower planar array of spaced apart, parallel electrically conductive leads electrically connected with and supporting said cathodes and a second upper planar array of spaced apart, parallel electrically conductive leads located above and spaced from said first array such that said second leads extend normal to said first leads, the improvement comprising at least one pair of separately formed adjacent upper and lower layers of dielectric material disposed between said first and second arrays of electrically conductive leads for electrically insulating the two arrays from one another, said adjacent layers together with the upper leads defining a matrix array of apertures, each of which contains a cathode of said array of cathodes.

2. The improvement according to claim 1 wherein each layer of said at least one pair of separately formed adjacent upper and lower layers of dielectric material is formed of the same dielectric material.

3. The improvement according to claim 1 wherein each layer of said at least one pair of separately formed adjacent layers of dielectric material is formed of different dielectric materials, each of which can be chemically etched by a particular chemical that will not chemically etch the other.

4. The improvement according to claim 3 wherein one layer of said at least one pair of separately formed layers of dielectric material is silicon nitride and wherein the other layer of said at least one pair of separately formed layers of dielectric material is silicon dioxide.

5. The improvement according to claim 1 wherein each of said apertures defined by said layers of dielectric material includes an upper section extending axially through said upper dielectric layer and a lower section extending axially through said lower dielectric layer and smaller in diameter than said upper segment, whereby to expose a section of the upper surface of said lower dielectric layer around each lower aperture section, and wherein said upper planar array of electrically conductive leads include segments which extend into said upper aperture section and onto the exposed upper surfaces of the lower dielectric layer around said lower aperture segments, said segments including their own aperture sections in alignment with said aperture sections.

6. The improvement according to claim 5 wherein said cathodes extend up from said lower leads within said apertures to the upper surface of said lower dielectric layer.

7. The improvement according to claim 1 wherein said lower dielectric layer is a film of anodized metal and wherein each of said lower leads is constructed of anodizable metal which has been anodized on its top surface to provide said film.

8. In a matrix addressing arrangement especially suitable for use as part of a matrix addressed flat panel display or other such device requiring matrix addressing, said arrangement including dielectric means supporting a first planar array of spaced apart, parallel, electrically conductive leads, a second planar array of spaced apart, parallel, electrically conductive leads located above and spaced from said first array such that the said second leads extend normal to said first leads, and at least one layer of dielectric material between said first and second arrays for electrically insulating the two arrays from one another, the improvement comprising:

a film of anodized metal serving as a dielectric layer between each of said first electrically conductive leads and said at least one layer of dielectric material.

9. The improvement according to claim 1 wherein said first leads are constructed of anodizable metal, each of said first leads being anodized on its top surface to provide said film.

10. The improvement according to claim 2 wherein said first leads are constructed of aluminum.

11. In a matrix addressed flat panel display, the improvement comprising:

(a) a dielectric base substrate;

(b) a lower planar array of spaced-apart, parallel electrically conductive leads;

(c) a matrix array of field emission cathodes connected to and extending up from said lower planar array of electrically conductive leads;

(d) an upper planar array of spaced-apart, parallel electrically conductive leads located above and spaced from said lower array of leads and said cathodes such that said upper leads extend normal to said lower leads crossing the latter immediately above said cathodes, and such that those segments of said upper leads that actually cross over said lower leads are positioned in a plane closer to said lower leads than the rest of said upper leads;

(e) means located between said upper and lower arrays of leads, except at said cathodes, for electrically insulating said arrays from one another, such that the uppermost points on said cathodes and the adjacent cross-over segments of said upper leads lie in substantially the same plane; and (f) means including said arrays of leads for energizing selected ones of said cathodes.

12. The improvement according to claim 11 wherein said insulating means includes upper and lower separately formed layers of dielectric material.

13. The improvement according to claim 12 wherein said lower layer has a thickness substantially equal to the spacing between said lower array of leads and the cross-over segments of said upper leads.

14. The improvement according to claim 13 wherein the uppermost points on said cathodes lie in the same plane as the cross-over segments of said upper leads.

15. In a device such as a matrix addressed flat panel display, the improvement comprising:

(a) a dielectric base substrate;

(b) a lower planar array of spaced-apart, parallel electrically conductive leads;

(c) a matrix array of field emission cathodes connected to and extending up from lower planar array of electrically conductive leads;

(d) an upper planar array of spaced-apart, parallel electrically conductive leads located above and spaced from said lower array of leads and said cathodes such that said upper leads extend normal to said lower leads crossing the latter immediately above said cathodes, and such that those segments of said upper leads that actually cross over said lower leads are positioned in a plane closer to said lower leads than the rest of said upper leads;

(e) means located between said upper and lower arrays of leads, except at said cathodes, for electrically insulating said arrays from one another, such that the uppermost points on said cathodes and the adjacent cross-over segments of said upper leads lie in substantially the same plane; and (f) means including said arrays of leads for energizing selected ones of said cathodes.

16. The improvement according to claim 15 wherein said insulating means includes upper and lower separately formed layers of dielectric material.

17. The improvement according to claim 16 wherein said lower layer has a thickness substantially equal to the spacing between said lower array of leads and the cross-over segments of said upper leads.

* * * * *